US006434868B1

(12) United States Patent
Bergeron

(10) Patent No.: US 6,434,868 B1
(45) Date of Patent: Aug. 20, 2002

(54) THREE-MESSAGES SIGN HAVING INTERNAL LIGHT SOURCE ILLUMINATION

(76) Inventor: Paul E. Bergeron, 15 Gate 61/2 Rd., Sausalito, CA (US) 94966

( * ) Notice: Subject to any disclaimer, the term of this patent is extended or adjusted under 35 U.S.C. 154(b) by 0 days.

(21) Appl. No.: 09/526,804

(22) Filed: Mar. 16, 2000

Related U.S. Application Data

(60) Provisional application No. 60/131,566, filed on Apr. 28, 1999.

(51) Int. Cl.[7] ..... G09F 11/02
(52) U.S. Cl. ..... 40/505; 40/502; 40/504
(58) Field of Search ..... 40/502, 503, 504, 40/505, 506

(56) References Cited

U.S. PATENT DOCUMENTS

| | | | | | |
|---|---|---|---|---|---|
| 3,313,131 | A | * | 4/1967 | Werner | 40/505 |
| 4,381,616 | A | * | 5/1983 | Saxer | 40/502 |
| 5,233,772 | A | * | 8/1993 | Bergeron et al. | 40/505 |
| 5,297,353 | A | * | 3/1994 | Ghalayini | 40/503 |
| 5,315,776 | A | * | 5/1994 | Strawbridge et al. | 40/505 |
| 5,416,996 | A | * | 5/1995 | Clemens et al. | 40/505 |
| 5,560,131 | A | * | 10/1996 | Gibson | 40/502 |
| 5,692,330 | A | * | 12/1997 | Anderson, Jr. | 40/505 |

* cited by examiner

*Primary Examiner*—Anthony Knight
*Assistant Examiner*—Doug Hutton
(74) *Attorney, Agent, or Firm*—William Michael Hynes; Townsend and Townsend and Crew, LLP

(57) ABSTRACT

A three-message sign having internal light source has an array of side-by-side triangular sign elements. Each of the triangular sign elements has three transparent display surfaces with three apices joining the three transparent display surfaces into the triangular sign element. The transparent display surfaces permit the array to display a discrete message when the array of triangular sign elements is simultaneously rotated to present the display surfaces for a single message. Each of the side-by-side triangular sign elements has a internal light source extending from at least one end of the triangular sign element across the transparent display surfaces of the triangular sign element. Transparent and opposed U-shaped holders are placed along edges of the transparent display surfaces, each transparent and opposed U-shaped element defining an indentation for trapping the edges of translucent message display strips. The translucent display strips permit light from the internal light source to back illuminate the translucent message display strips. An opaque barrier is placed at the apices of the triangular sign elements for blocking light passage through the transparent and opposed U-shaped holders. This opaque barrier prevents light passing between the edges of the translucent message display strips through the apices of the triangular sign elements. This prevents a moving strip of light when rotation of the side-by-side triangular sign elements occurs. Translucent message carrying strips are mounted to the display surfaces between the transparent and opposed U-shaped holders. These translucent message carrying strips are wider than an interval between the transparent and opposed U-shaped holders. This width causes the translucent message carrying strips to accurately bow away from a flat disposition to an arcuate disposition concave with respect to the internal light source to provide apparent even illumination to the translucent message carrying strip.

6 Claims, 9 Drawing Sheets

THREE-MESSAGES SIGN HAVING INTERNAL LIGHT SOURCE ILLUMINATION

This invention relates to three message-rotating signs such as disclosed in Bergeron et al U.S. Pat. No. 5,233,772, issued Aug. 10, 1993, entitled Multi-Message Sign. More particularly, this disclosure adds to that design illumination of the rotating three-sign elements with an internal light source. Improvements for mounting the illuminated message strips and shading of the apices to prevent distracting illuminated strips from rotating across the field of view are disclosed.

This Non-Provisional Patent Application claims the benefit of Provisional Patent Application Ser. No. 60/131,566 filed Apr. 28, 1999, entitled Three-Message Sign Having Central Strip Illumination, the disclosure of that Application incorporated verbatim herein.

In the following disclosure, Bergeron et al U.S. Pat. No. 5,233,772, issued Aug. 10, 1993, entitled Multi-Message Sign is incorporated by reference as if fully set forth herein.

BACKGROUND OF THE INVENTION

In Bergeron et al U.S. Pat. No. 5,233,772, issued Aug. 10, 1993, entitled Multi-Message Sign Paul E. Bergeron, the named inventor herein, and David L. Wood disclosed a new and novel rotating sign. Specifically, there was disclosed a driving butterfly cam in combination with a triangular cam follower attached to side-by-side rotating triangular sign elements. In short, this design discloses a highly successful rotating three-message display. Simply stated by having the side-by-side triangular sign elements rotate together, three sequential messages are repeatedly displayed.

It has been known to place illumination centrally of each side-by-side triangular sign element. However, practical signs of this design have not yet achieved full commercial acceptability. Examining carefully the design of Bergeron et al. U.S. Pat. No. 5,233,772, issued Aug. 10, 1993, entitled Multi-Message Sign, it has been found that this design is a perfect place for the placement of an internal light source, such as a central fluorescent tube, in each of the side-by-side triangular sign elements. The portions of the drive cams and journals required for the rotation of the sign elements naturally fit around internal light source, such as a stationary fluorescent tube. The exact parameters of how an internal light source to this design of sign were under development at the time of the filing of the Provisional Patent Application. What follows is a record of the development of this sign as of the date of filing of the Provisional Patent Application in the United States.

Each of the three messages of such signs is contained on sign strips. Where the sign strips are back illuminated, it is required that the message carrying sign strips be translucent. The translucent message carrying sign strips have to be held to the individual sides of the three-element rotating strips. For each of the three messages displayed, a set of translucent message strips is installed across the sign face with one strip carrying the sequential information on each sign element. There is herein developed the use of translucent and opposed U-shaped transparent holders extending the length of the sign elements at the edges of the three transparent display surfaces of the sign elements. These U-shaped transparent fittings oppose one another. When a translucent sign strip is inserted between the opposed translucent U-shaped edges, it is captured and held flat to the mating flat surface of the rotating three sided sign element.

It is important to understand why the translucent message carrying strips must be held by translucent opposed U-shaped elements. The translucent strips must be back illuminated to their edges. If the edges are blacked out or otherwise obscured, both a visual distraction and some obscuration of the message will occur. Accordingly, by making the retaining and opposed U-shaped members translucent, convenient insertion and withdrawal of these strips can occur with illumination extending to the edge of the strips extending across the message display surface of the sign.

In testing illumination of this three-dimensional sign, two problems were discovered, which problems are not disclosed and set forth in the prior art. As it is well understood that discovery of a problem can be combined with the solution to the problem, it will be understood that invention is claimed in recognizing the problem as well as solving the problem once known. No reference to the existence of these problems was found in the prior art.

PROBLEMS DISCOVERED

When three-element rotating sign elements were centrally illuminated by illumination extending centrally of the rotating three-sided element, it was discovered that the centrally extending illumination causes the central portion of the translucent message carrying strip to be brightly illuminated. This is to be contrasted with those portions of the translucent message carrying strip that are at the edges of each display surface of the rotating triangular sign element. These edge portions of the back illuminated translucent message carrying strips are more remote from the internal light source. These edge portions appear noticeably darker. This uneven illumination is distracting and renders an unsatisfactory appearance where the sign is illuminated by a centrally extending source of illumination.

Given the uneven illumination, it is believed the reason for the uneven illumination to be the so-called "inverse square law" related to light and other radiation. Simply stated, the intensity of light varies with the inverse square of the distance of the light source to the illuminated surface. For a small advertising sign utilized at indoor locations, thepreferred internal light source is a fluorescent tube is ¼ inch in diameter. The rotating triangular sign elements are 2 inches on each side. When laid flat over the display surface of the rotating triangular sign element, the central portion of the back illuminated translucent message carrying sign strip is ½ inch away from the central fluorescent tube. The peripheral portions of the back illuminated strip are 1 inch away from the central fluorescent tube. The intensity of the illumination at the center of the back illuminated translucent message carrying strips is at least four times the intensity of the illumination at the strip edges. It will be appreciated that as the scale of the sign changes, the above dimension can proportionally change when the dimensions of the sign change.

A discovery has also been made related to the translucent and opposed U-shaped holders. It was found that the translucent and opposed U-shaped holders can radiate light to the viewer. The translucent and opposed U-shaped strip retaining elements form a bright boarder as the three message sign either displays its sequential messages or changes its sequential messages. As all of the elements of a multi-element three message sign rotate together, the brightly illuminated strips between the individual message strips of the sign likewise move together across the field of view of the sign message. The result is unbelievably distracting, rendering the rotating sign message display commercially unacceptable.

Having identified a bright boarder as a problem, the natural solution would be to render the translucent and opposed U-shaped holders of the individual sign message strips opaque. This will not result in the desired visual effect. Illumination is required to the edge of such strips. Accordingly, opaque opposed U-shaped holders at the edge of such sign elements would obscure portions of the back illuminated translucent message carrying sign strips. Such opaque holders cannot be used.

As a result of the recognition and study of these problems, there is developed herein a sign strip display that does away with both of these problems.

FURTHER PROBLEMS DISCOVERED

Between the filing of the Provisional Patent Application referenced above, and the filing of this Non-Provisional Patent Application, two remain problems that relate to the placement of central fluorescent tubes were found.

The first problem relates to the holding of the triangular sign elements themselves. It was found that bracing of display surfaces at the ends of the triangular sign elements can cause shadowing of the display surfaces at the ends of the triangular sign elements. Specifically, at the top and bottom of each flat display surface, shadowing occurs where the vane is mounted for rotation. These dark patches are distracting and interfere with the effectiveness of the message being displayed.

The second problem relates to an internal light source within the sign elements. Specifically, from time to time, internal light sources, such as fluorescent bulbs, fail. Each time a light source fails, it needs to be replaced at minimum cost without requiring either substantial sign disassembly or alternatively the presence of especially trained personnel to make the replacement. Accordingly, a new way of mount both the internal light source, such as the fluorescent bulb, and the rotating vane was required for facilitating both vane removal and internal light source replacement.

SUMMARY OF THE INVENTION

A three-message sign having internal light source has an array of side-by-side triangular sign elements. Each of the triangular sign elements has three transparent display surfaces with three apices joining the three transparent display surfaces into the triangular sign element. The transparent display surfaces permit the array to display a discrete message when the array of triangular sign elements is simultaneously rotated to present the display surfaces for a single message. Each of the side-by-side triangular sign elements has a internal light source extending from at least one end of the triangular sign element across the transparent display surfaces of the triangular sign element. Transparent and opposed U-shaped holders are placed along edges of the transparent display surfaces, each transparent and opposed U-shaped element defining an indentation for trapping the edges of translucent message display strips. The translucent display strips permit light from the internal light source to back illuminate the translucent message display strips. An opaque barrier is placed at the pieces of the triangular sign elements for blocking light passage through the transparent and opposed U-shaped holders. This opaque barrier prevents light passing between the edges of the translucent message display strips through the apices of the triangular sign elements. This prevents a strip of light when either static display or rotation of the side-by-side triangular sign elements occurs. Translucent message-carrying strips are mounted to the display surfaces between the transparent and opposed U-shaped holders. These translucent message-carrying strips are wider than an interval between the transparent and opposed U-shaped holders. This width causes the translucent message carrying strips to arcuately bow away from a flat disposition to an arcuate disposition concave with respect to the internal light source to provide apparent even illumination to the translucent message carrying strip.

As of the filing of this Non-Provisional Patent Application, two additional features have been added. First, all vanes are held between their respective flat transparent display surfaces by bisecting planar holders. These bisecting planar holders do not shade the respective flat transparent display surfaces and enable the translucent message display surfaces to be evenly illuminated at the rotating sign element ends. Secondly, a flexible U-shaped support is provided to at least one end of each rotating sign element. The "U" of the U-shaped support opens outwardly from the displaying surface of the sign. Utilizing a standard mounting fixture, both the triangular rotating element and the internal light source may be rotated out of engagement with and detached from the sign. Thereafter, a new internal light source, such as a fluorescent bulb can be threaded to the triangular rotating sign element, and the triangular rotating sign element rotated back into engagement with and attached to the sign.

DESCRIPTION OF THE SPECIFIC EMBODIMENTS

Figure 1:
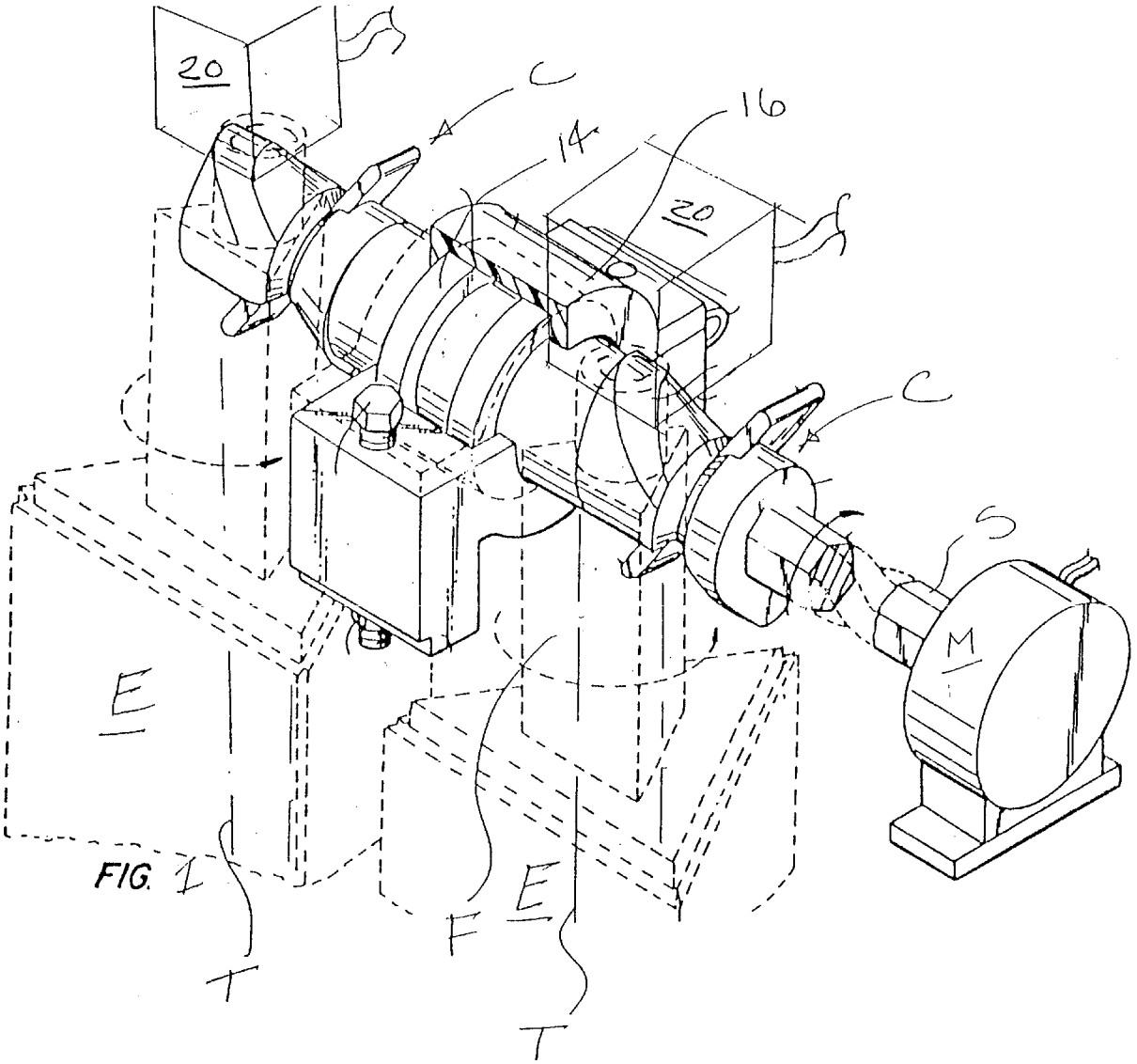
FIG. 1 is a perspective view of the rotating sign element drive disclosed in Bergeron et al. U.S. Pat. No. 5,233,772, issued Aug. 10, 1993, entitled Multi-Message Sign, this view showing the introduction of the internal light source, here fluorescent tubes, through the drive structure.

Referring to FIG. 1, the drive mechanism of Bergeron et al U.S. Pat. No. 5,233,772 is set forth. As that reference contains a full disclosure, the drive will here be described in a summary fashion.

Motor M rotates keyed shaft S1. Riding on keyed shaft S1, butterfly cam C acts on triangular cam follower F. Triangular cam follower F is integral to centering member 14 which rides on pillow block 16. In the particular arrangement shown, centering member 14 connects two butterfly cams C.

Each triangular cam follower F is connected to a triangular sign element E. Naturally, as butterfly cams C cause triangular cam follower F to rotate, the individual triangular sign element E each rotate.

Figure 2:
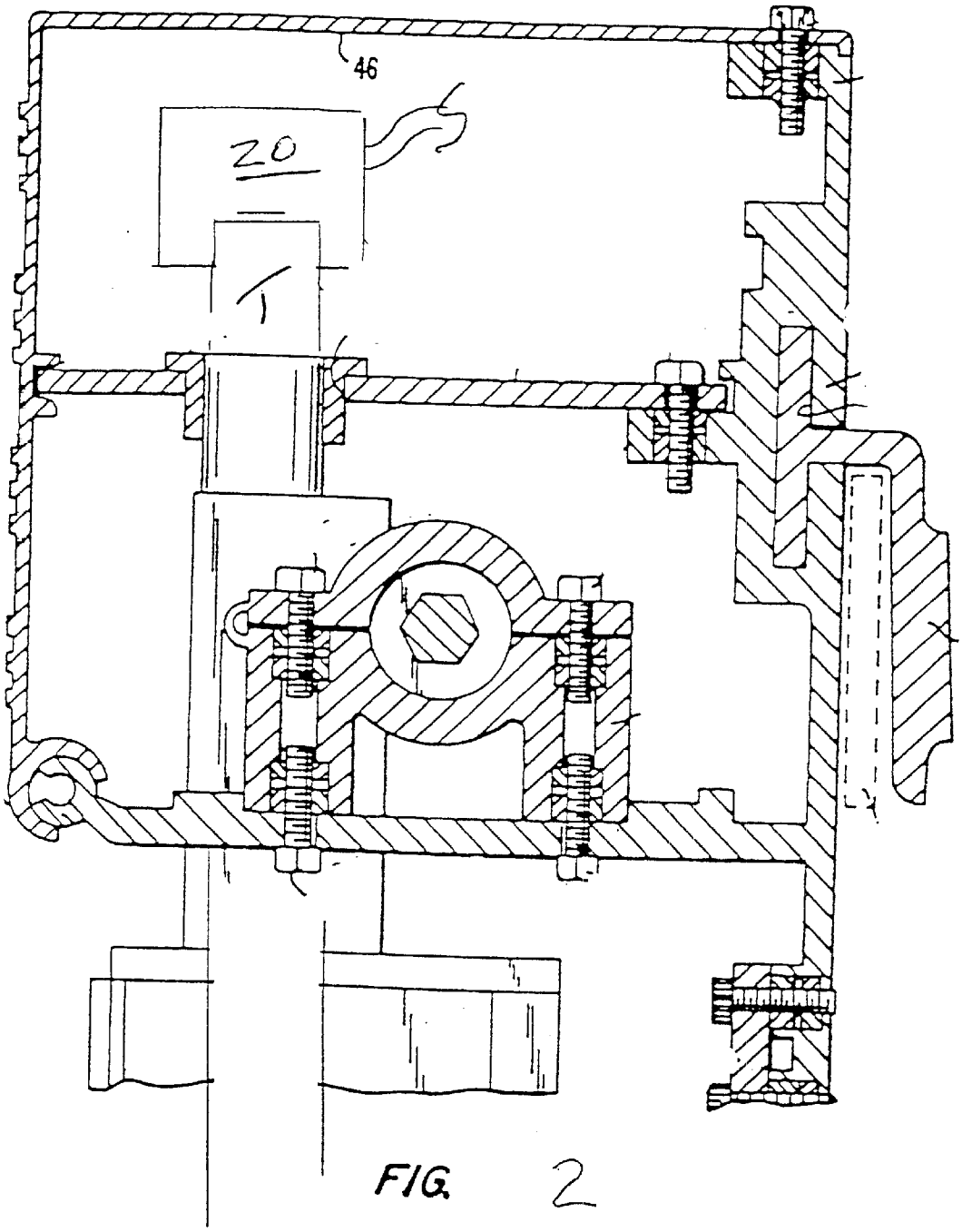
FIG. 2 illustrates a side elevation of the drive mechanism shown in FIG. 1 with the internal light source being shown from a different angle.
Figure 3:
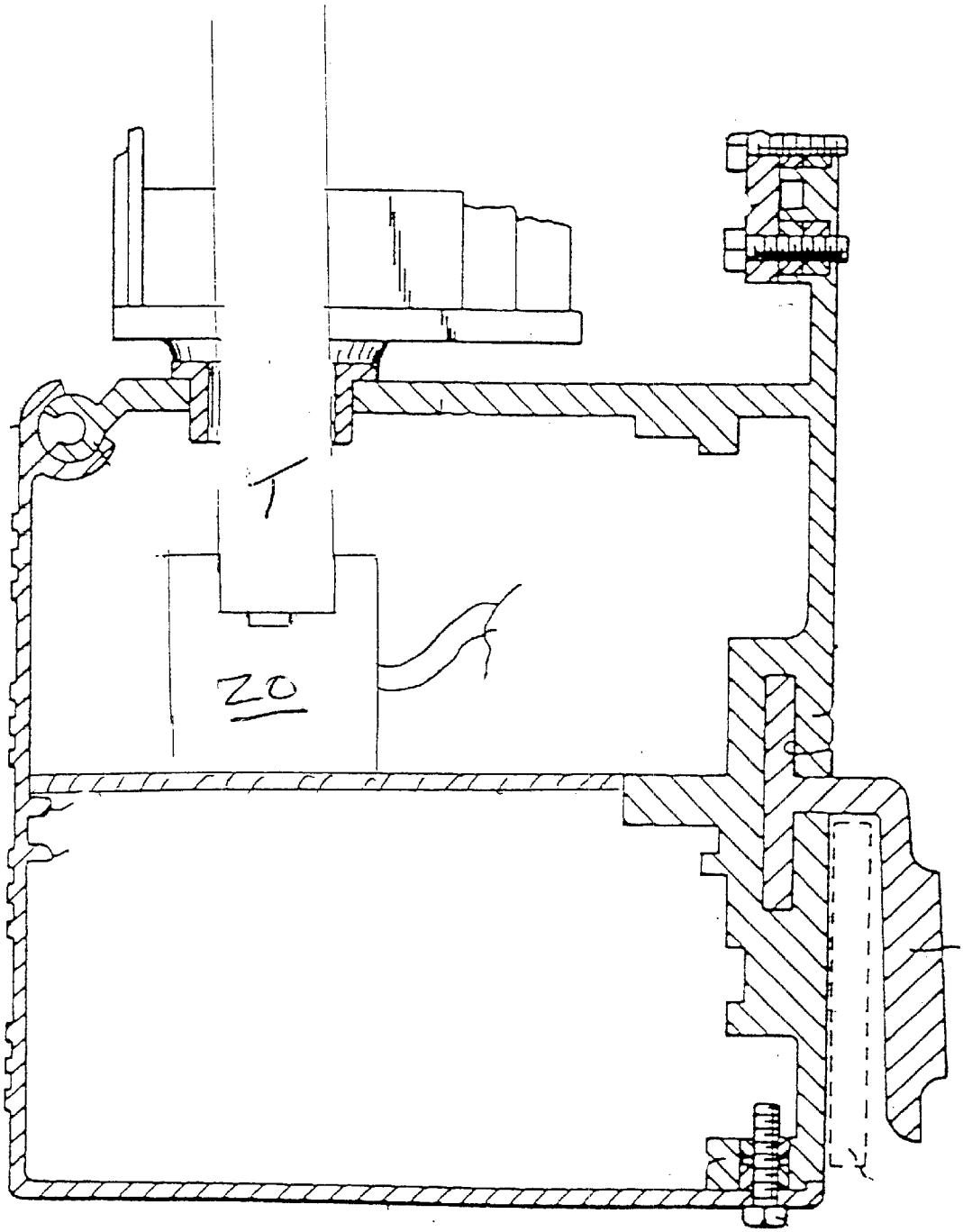
FIG. 3 illustrates the opposite end of the rotating sign element shown in FIGS. 1 and 2 and also shows the opposite end of the internal light source.

Over the disclosure in the previous U.S. Pat. No. 5,233,772, it will be seen that the inventor has added internal light source, here in the form of fluorescent tubes T. As presently developed, central fluorescent tubes T are stationary, and are held between commercially available end fittings 20 (See FIGS. 1, 2 and 3). As presently utilized central fluorescent tubes T does not rotate while triangular sign element E each rotate around the stationary central fluorescent tubes T.

It is understand that in the preferred embodiment of this invention, I disclose a fluorescent tube T. Other sources of illumination will work as well. For example, a light rope, diodes, diodes on strips, radially emitting fiber optics, incandescent lamps (for example illuminating the rotating triangular elements at the ends), and the like all can be used. It will be understood that the words "internal light source" cover all these expedients.

Figure 4:
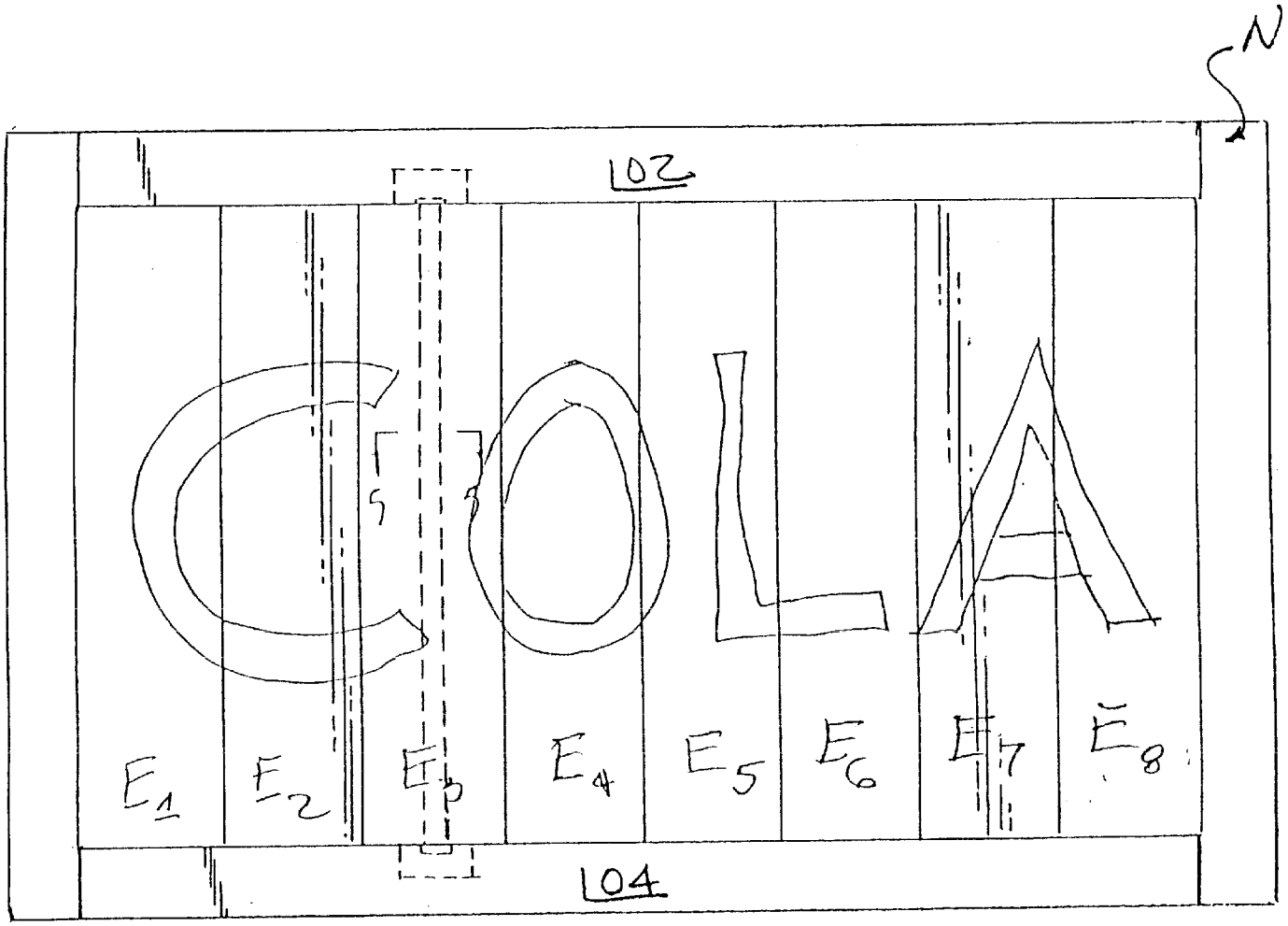
FIG. 4 is a front elevation of the multi-message sign of this invention with one triangular sign element showing in broken lines the placement of the internal light source.
Figure 5A:
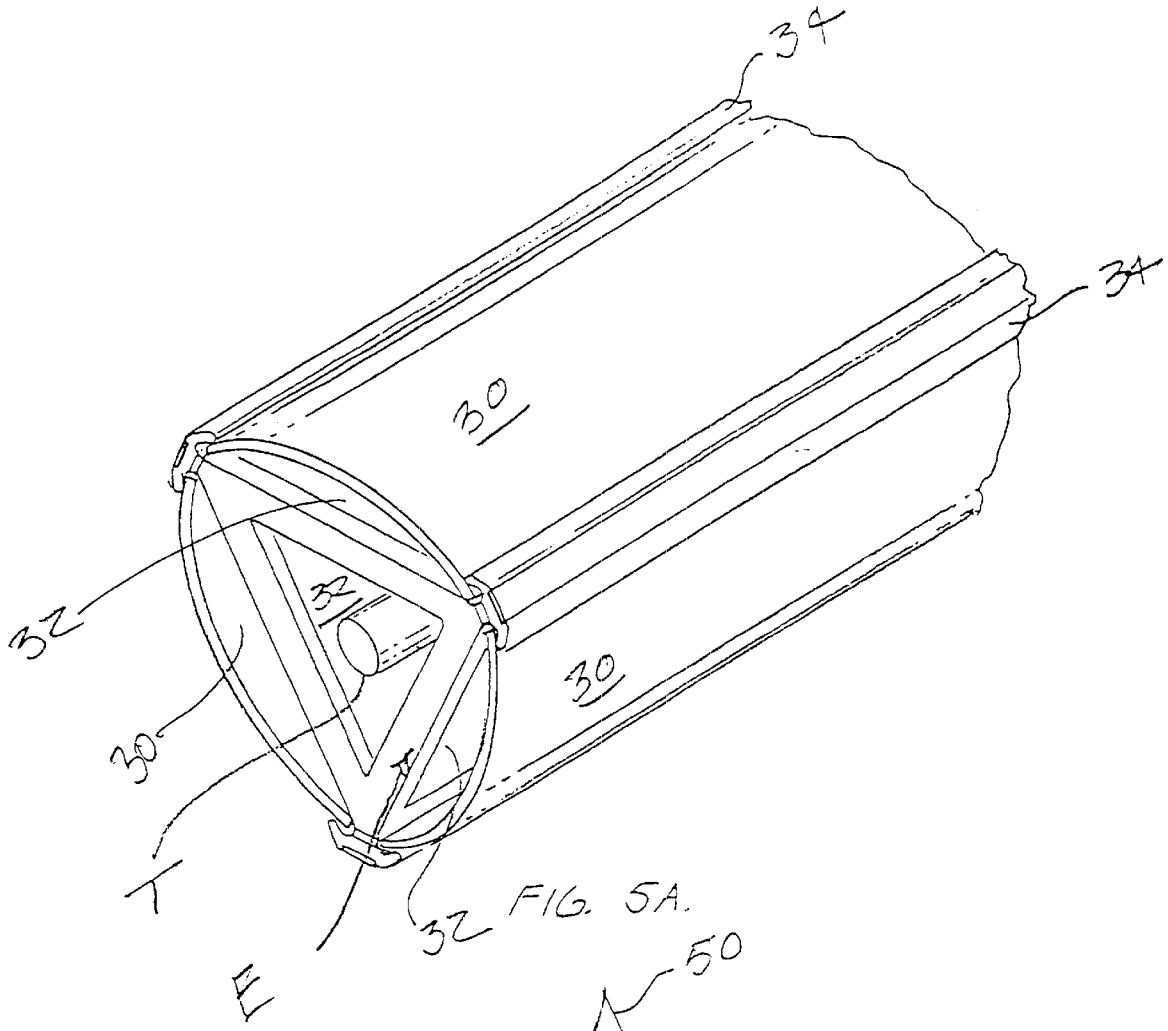
FIGS. 5A and 5B are details of the holding of the back illuminated translucent strips to the display surfaces of the triangular sign elements.
Figure 5B:
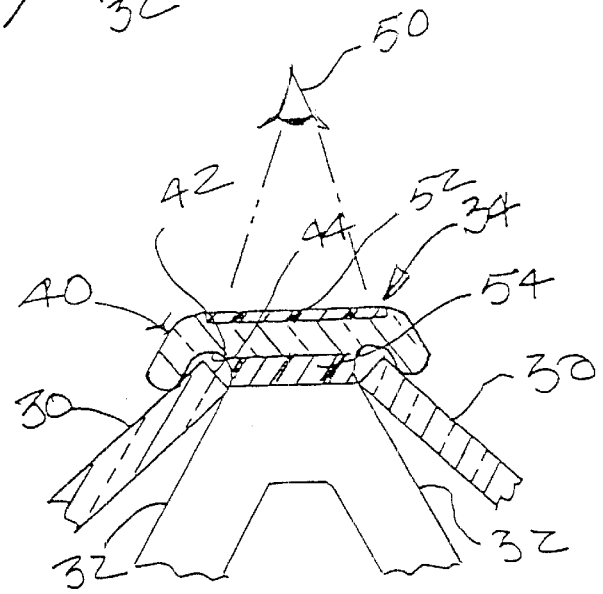

Referring to FIG. 4, sign N having the "COLA" on a three-element array is shown with triangular sign element E1–E8. It is understood that elements E1 through E8 include two other messages not shown; rotation of triangular sign element E1–E8 will render the these messages visible. FIGS. 5A and 5B are taken along lines 5—5 of FIG. 4.

Referring to FIG. 5A, internal light source T is shown disposed centrally of triangular sign element E. Three translucent message display surfaces 30 are disposed about flat transparent display surfaces 32. The reader will understand that the "flat display surfaces 32" can either be real flat surfaces or an open frame.

Viewing FIG. 5A it will be understood that the elongate edges 34 are provided with transparent and opposed U-shaped holders 40. Viewing these transparent and opposed U-shaped holders 40 at elongate edges 34 two observations may be made.

First, each of the flat transparent display surfaces 32 is in the order of 2 inches of width. Second, each translucent message display surfaces 30 is in the order of 2⅛ inches wide. In order for translucent message display surfaces 30 to fit over flat transparent display surfaces 32, the translucent message display surfaces 30 must adopt an accurate configuration. The arcuate configuration is concave with respect to internal light source T. Further, although the total configuration of all three translucent message display surfaces 30 is not quite circular, it does have a slight circular configuration. I have found that this slight circular configuration imparts uniform illumination from internal light source T to translucent message display surfaces 30.

Secondly, and referring to FIG. 5B, a second feature can be understood. In order for the fill extent of translucent message display surfaces 30 to be back illuminated to the elongated edge of each of the individual translucent message display surfaces 30, transparent and opposed U-shaped holders 40 must be transparent. If they were not transparent, portions of transparent and opposed U-shaped holders 40 would overlie translucent message display surfaces 30. At this point they would disrupt the continuity of the image appearing at FIG. 4.

However, it has been found that if the entire elongate edges 34 at transparent and opposed U-shaped holders 40 are left transparent, an extraordinarily distracting effect will occur. Specifically, the eye 50 of a viewer will see the light images when stationary and when passing across the message plane. By looking at FIG. 4, and imagining four such white and lit lines traversing each of the triangular sign element E1–E8, the reader can get some idea of the resulting distraction.

This effect is cured by placement of at least one opaque barrier across elongate edges 34. In FIG. 5B, I show a first barrier 52 attached to the outside of elongate edges 34. Alternately, elongate edges 34 may be co-extruded with an internal opaque barrier 54. In either event the light path from internal light source T to eye 50 will be blocked as triangular sign element E is either stationary or rotates.

This line phenomenon was found to be surprisingly distracting.

Figure 6A:
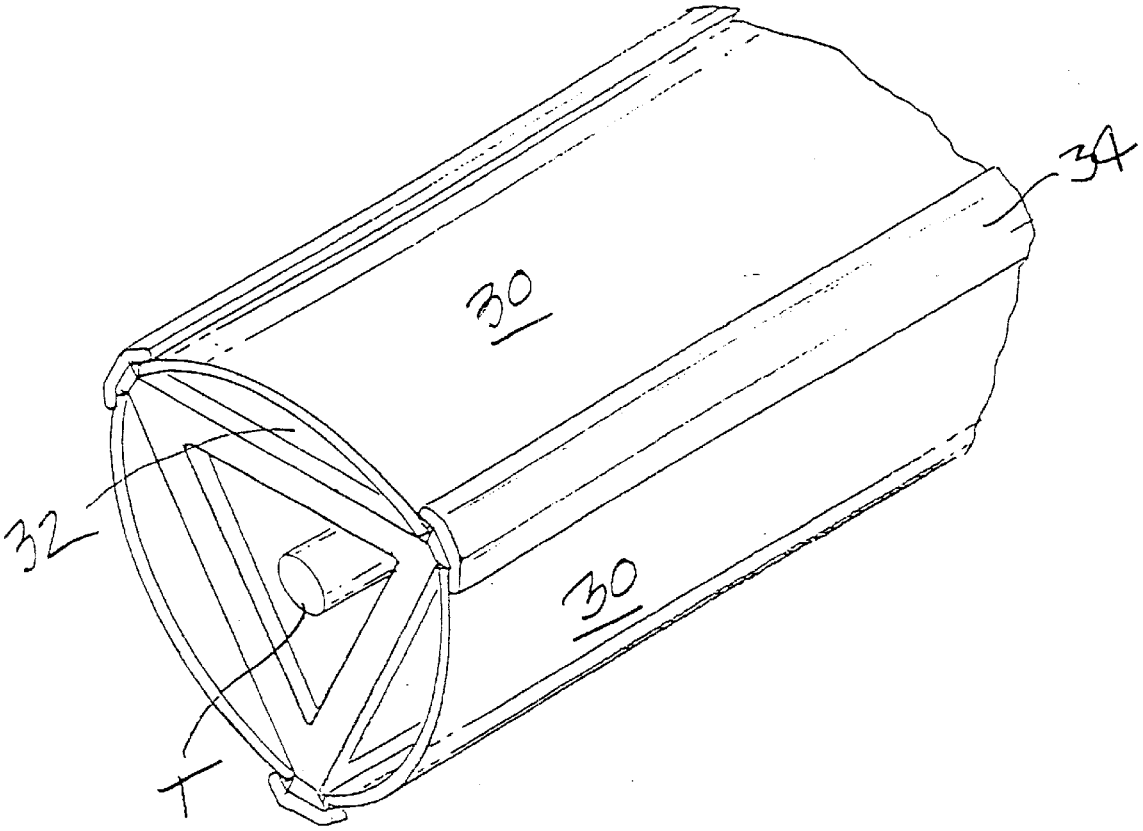
FIGS. 6A and 6B are details similar to FIGS. 5A and 5B with the opposed U-shaped holders given an alternate disposition.
Figure 6B:
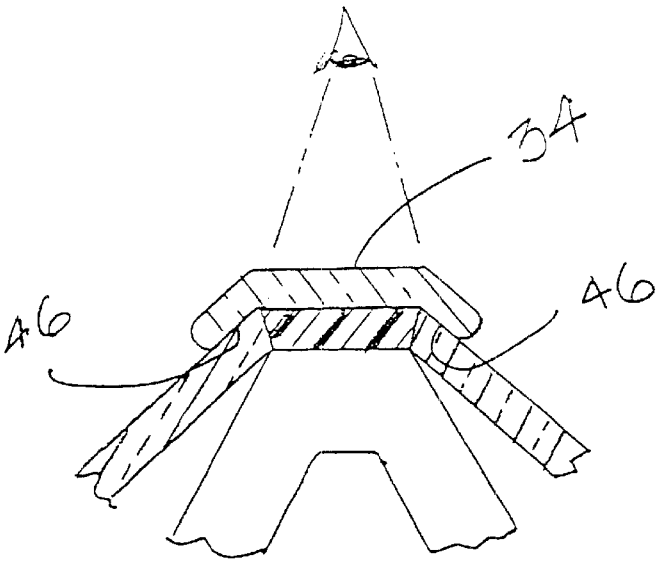

The reader will understand that elongate edges 34 at transparent and opposed U-shaped holders 40 can have different configurations. For example, in FIG. 6B it will be seen that transparent and opposed U-shaped holders 40 have been provided with sloped edge 46. Sloped edge 46 matches that slope which the edge of translucent message display surfaces 30 has at elongate edges 34.

Since the filing of the Provisional Patent Application, the construction of ends of the triangular sign elements has been perfected. This construction can be seen and understood referring to FIGS. 7A, 7B, 7C and 8.

First, I have added a hollow protruding cylinder 60 to each end cap A of triangular sign elements. In the view of FIG. 7A, hollow protruding cylinder 60 is shown attached to the end of triangular cam follower F. It will be understood that such a protruding cylinder is mounted on the opposite end the triangular sign element E, but is not shown.

Figure 7B:
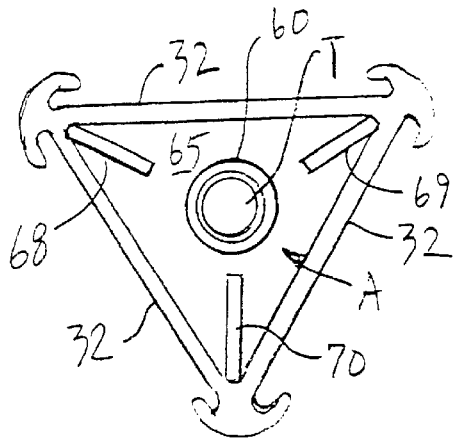
FIG. 7B is a plan view of end cap having bisecting partitions holding the flat transparent display surfaces without causing shading at the end of the sign elements, the arcuate translucent message display surfaces being omitted so that just the structure of the end cap holding the triangular rotating sign element can be seen.
Figure 7A:
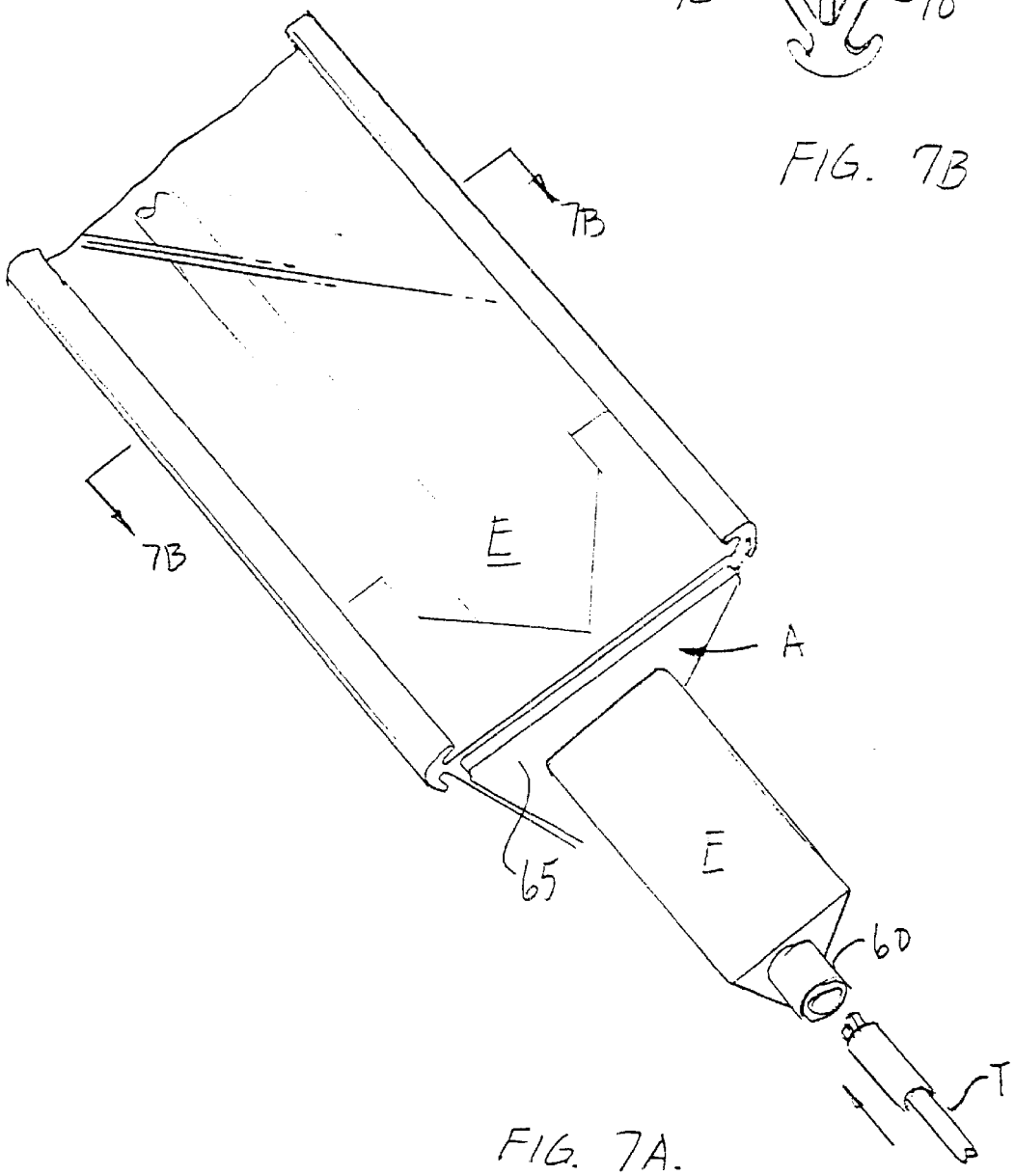
FIG. 7A illustrates one of the triangular sign elements at its end with the protruding triangular cam, the triangular cam in turn having a protruding cylinder, the protruding cylinder, triangular cam, and triangular sign element shown being threaded with the internal light source.

Second, and referring to FIG. 7B, the construction of end cap A relative to translucent surfaces 32 can be understood. End cap A is provided with a triangular end plate 65. Mounted on the inside of triangular end plate 65 and protruding into triangular sign element E are three mounting partitions 68, 69, and 70. The mounting partitions having two main features.

The mounting partitions 68, 69, and 70 each bisect the angle of their adjacent transparent sign display surfaces 32. In this way, the partitions do not shade any portion of the transparent sign display surfaces.

Additionally, mounting partitions 68, 69, and 70 at their portions remote from hollow protruding cylinder 60 have spacing to spring into an interference fit inside of the ends of triangular sign elements E. The result will be that support without shading of light from internal light source T will occur.

It is necessary to capture protruding cylinder 60 for rotation. At the same time it is necessary to allow the end cap A at protruding cylinder 60 to be captured and removed from its rotating disposition within the sign. This is permitted by resilient capture block 75.

Figure 7C:
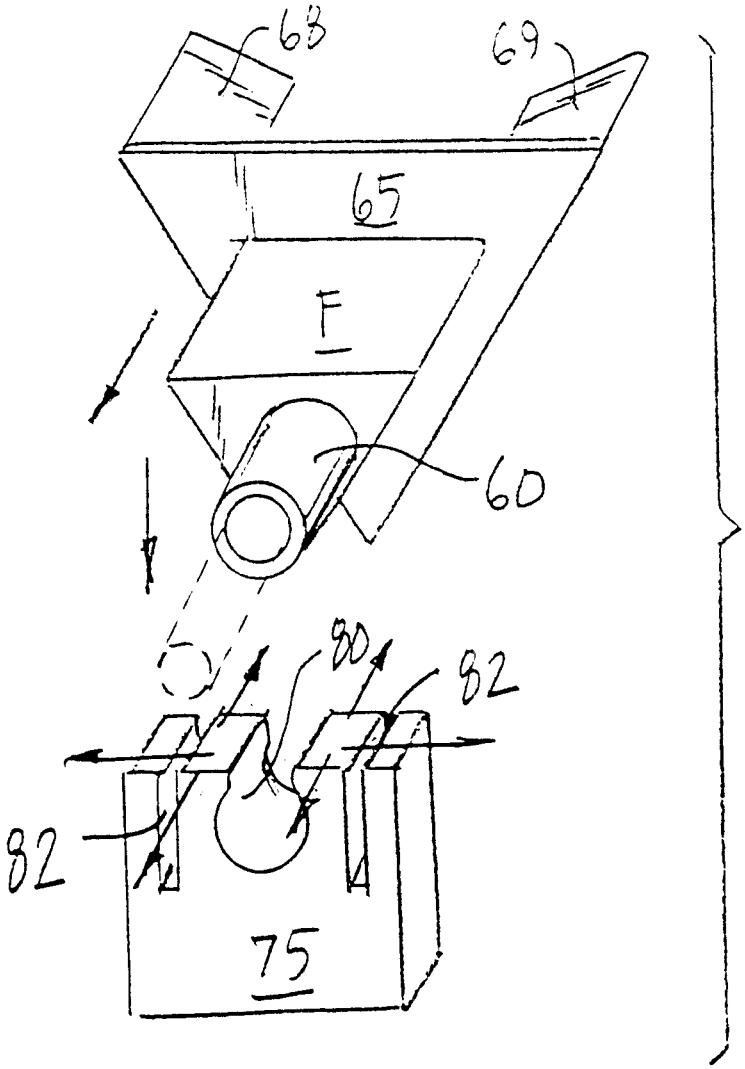
FIG. 7C is an exploded view of the end cap for holding the triangular rotating sign element, the triangular cam follower, and the protruding cylinder (without the threaded internal light source) overlying a flexible end piece for elastically capturing the triangular rotating sign element at the protruding cylinder; and, FIG. 8 is a perspective assembly view of the flexible end piece, internal light source socket, internal light source, end cap having bisecting partitions, and triangular rotating sign element in the assembled disposition, this construction replacing that side construction of the sign illustrated at FIGS. 2 and 3.

Referring further to FIG. 7C at resilient capture block 75, it will be seen that the block defines a U-shaped cavity 80. U-shaped cavity 80 has a dimension at the top of the "U" slightly less that the diameter of protruding cylinder 60. It will be seen that on opposite sides of the "U", resilient block 75 is provided with slots 82. Slots 82 extend from the top of resilient block 75 downward to and toward the bottom of the block for approximately the depth of U-shaped cavity 80.

Remembering that block 75 is resilient, its function can be easily understood. First, and looking at the detail of FIG. 7C, it is immediately seen that if end cap A is moved downwardly on and into resilient block 75, capture of protruding cylinder 60 will occur. Secondly, if end cap A is moved toward resilient block 75, spring biased movement against block 75 can occur. It will be understood that this spring biased movement towards and away from block 75 of cap A enables replacement of the triangular sign element and internal light source T from the front face of the sign of FIG. 4.

It will be seen that block 75 produces a snug interference fit sufficient to hold the triangular sign element E. This interference fit permits movement of the triangular sign elements E into, and out of, the plane of sign N. Further, the triangular sign element can spring against block 75 longitudinally of its length. With this longitudinal movement, the sign element can be moved into and out of rotational engagement with the sign at an end opposite from block 75.

It will be understood that any of a number of fittings can provide the same results. What is achieved is the ability to elastically displace the triangular sign elements E to and from the sign mounting for sign servicing by unskilled personnel.

Figure 8:
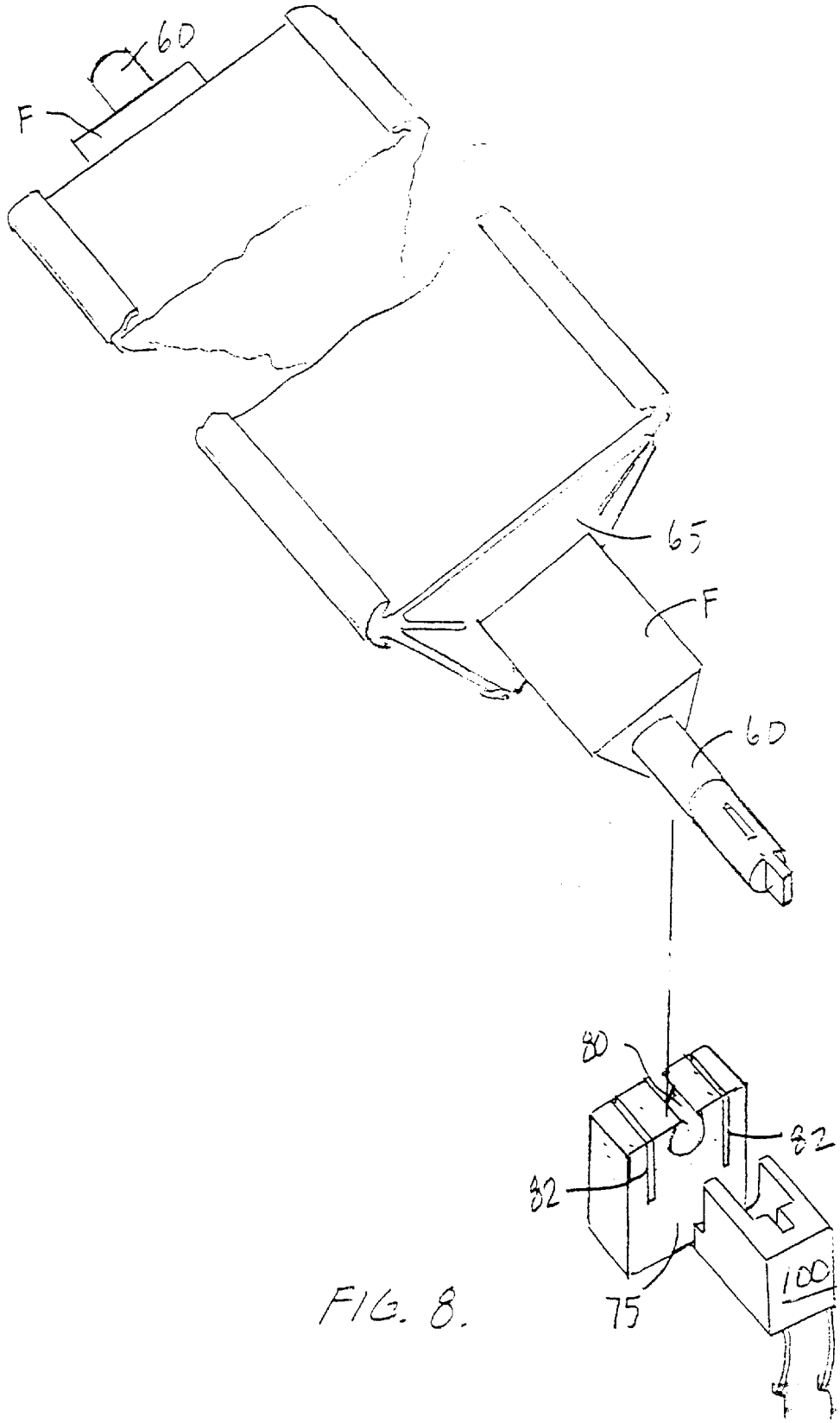

Referring to FIG. 8, final assembly of the sign is illustrated. Specifically, standard mounting fixture 100 is shown directly behind block 75. It can be seen that triangular sign element E can be pushed into, and rotated from engagement with both block 75 and standard mounting fixture 100. It will be understood that tube T does not rotate and that triangular sign element E rotates around the stationary tube T.

Referring to FIG. 4, it is necessary that the construction of the sign edges be modified. Specifically, top edge 102 and bottom edge 104 are removable so that the access illustrated in FIG. 8 can occur.

What is claimed is:

1. A three-message sign having an internal light source comprising:

an array of side-by-side triangular sign elements, each of the triangular sign elements having three transparent display surfaces with three apices joining the three transparent display surfaces into the triangular sign element, each transparent display surface for permitting the array to display a discrete message when the array of triangular sign elements is simultaneously rotated to present the display surfaces for a single message;

each of the side-by-side triangular sign elements having an internal light source extending from at least one end of the triangular sign element across the transparent display surfaces of the triangular sign element;

transparent and opposed U-shaped holders placed along edges of the transparent display surfaces, each transparent and opposed U-shaped element defining an indentation for trapping the edges of translucent message display strips and permitting light from the internal light source to back illuminate the translucent message display strips; and, an opaque barrier at the apices of the triangular sign elements for blocking light passage through the transparent and opposed U-shaped holders to prevent light passing between the edges of the translucent message display strips through the apices of the triangular sign elements whereby a moving strip of light is avoided on rotation of the side-by-side triangular sign elements.

2. A three-message sign having internal light source according to claim 1 and further including:

translucent message carrying strips, the translucent message carrying strips mounted between the transparent and opposed U-shaped holders;

the translucent message carrying strips being wider than an interval between the transparent and opposed U-shaped holders to cause the translucent message carrying strips to accurately bow away from a flat disposition to an accurate disposition concave with respect to the internal light source to provide apparent even illumination to the translucent message carrying strip.

3. A three-message sign having an internal light source comprising:

an array of side-by-side triangular sign elements, each of the triangular sign elements having three transparent display surfaces with three apices joining the three transparent display surfaces into the triangular sign element, each transparent display surface for permitting the array to display a discrete message when the array of triangular sign elements is simultaneously rotated to present the display surfaces for a single message;

each of the side-by-side triangular sign elements having a internal light source extending from at least one end of the triangular sign element across the transparent display surfaces of the triangular sign element;

transparent and opposed U-shaped holders placed along edges of the transparent display surfaces, each transparent and opposed U-shaped element defining an indentation for trapping the edges of translucent message display strips and permitting light from the internal light source to back illuminate the translucent message display strips; and, translucent message display strips, the translucent message display strips mounted between the transparent and opposed U-shaped holders;

the translucent message display strips being wider than an interval between the transparent and opposed U-shaped holders to cause the translucent message display strips to arcuately bow away from a flat disposition to an arcuate disposition concave with respect to the internal light source to provide apparent even illumination to the display strip.

4. A three-message sign having internal light source according to claim 3 and further including:

an opaque barrier at the apices of the triangular sign elements between for blocking light passage through the transparent and opposed U-shaped holders to prevent light passing between the edges of the translucent message display strips through the apices of the triangular sign elements whereby a moving strip of light is avoided with rotation of the side-by-side triangular sign elements.

5. A three-message sign having an internal light source comprising:

an array of side-by-side triangular sign elements, each of the triangular sign elements having three transparent display surfaces with three apices joining the three transparent display surfaces into the triangular sign element, each transparent display surface for permitting the array to display a discrete message when the array of triangular sign elements is simultaneously rotated to present the display surfaces for a single message;

each of the side-by-side triangular sign elements having an internal light source extending from at least one end of the triangular sign element across the transparent display surfaces of the triangular sign element;

transparent and opposed U-shaped holders placed along edges of the transparent display surfaces, each transparent and opposed U-shaped element defining an indentation for trapping the edges of translucent message display strips and permitting light from the internal light source to back illuminate the translucent message display strips;

at least one end plate including three opposed holders for holding the triangular sign elements, the opposed holders disposed at the end corners of the triangular sign elements at an angle between the angle of adjacent transparent display surfaces, whereby light from the internal light source is distributed to each of the two transparent display surfaces adjacent the end plate without substantial shadow.

6. A three-message sign having an internal light source according to claim 5 further comprising:

the opposed holders bisect the angle between the transparent display surfaces.

* * * * *